United States Patent [19]

Barishman et al.

[11] Patent Number: 4,725,257

[45] Date of Patent: Feb. 16, 1988

[54] DOLL WITH GRIPPING HAND CONSTRUCTION AND CLIP THEREFOR

[75] Inventors: Michael S. Barishman, Agawam, Mass.; Lester H. Olinsky, Avon, Conn.

[73] Assignee: Coleco Industries, Inc., West Hartford, Conn.

[21] Appl. No.: 858,167

[22] Filed: May 1, 1986

[51] Int. Cl.[4] ..... A63H 3/02; A63H 3/36; A63H 3/04

[52] U.S. Cl. ..... 446/370; 446/373; 446/390; 24/545; 623/65

[58] Field of Search ..... 446/296, 370, 371, 373, 446/374, 376, 382, 383, 390, 369, 379; 24/545, 561, 67.11, 560, 67.3; 623/65, 57

[56] References Cited

U.S. PATENT DOCUMENTS

| | | | |
|---|---|---|---|
| 113,532 | 4/1871 | Lacmann | 446/396 |
| D. 144,079 | 3/1946 | Smith | 24/545 X |
| 172,262 | 1/1876 | Cummings et al. | 24/545 |
| 204,927 | 6/1878 | Warren | 24/560 |
| 348,871 | 9/1886 | Wales | 24/561 X |
| 440,986 | 11/1890 | Alderson | 446/359 |
| 620,598 | 3/1899 | Lyons | 446/373 |
| 948,615 | 2/1911 | McShane | 24/545 |
| 1,402,345 | 1/1922 | Felkner | 446/370 |
| 2,059,338 | 4/1934 | Goodsill | 223/68 |
| 2,733,545 | 2/1956 | Guadagna | 446/330 |
| 2,884,739 | 5/1959 | Ketcham | 446/376 |
| 2,931,086 | 4/1960 | Rose | 24/545 |
| 2,983,013 | 5/1961 | Mader | 24/561 X |
| 3,071,893 | 1/1963 | Schwartz | 446/390 |
| 3,693,288 | 9/1972 | Lewis et al. | 446/330 |
| 3,696,553 | 10/1972 | Lewis et al. | 446/330 |
| 3,955,312 | 5/1976 | Pugh | 446/383 |
| 4,186,517 | 2/1980 | Kuhn et al. | 446/330 |
| 4,361,935 | 12/1982 | Paxton | 24/561 X |
| 4,655,424 | 4/1987 | Oshida | 24/545 X |

FOREIGN PATENT DOCUMENTS

| | | | |
|---|---|---|---|
| 464992 | 4/1937 | United Kingdom | 446/374 |
| 1526939 | 10/1978 | United Kingdom | 446/376 |
| 315654 | 11/1919 | Fed. Rep. of Germany | 24/545 |

*Primary Examiner*—Richard T. Stouffer
*Assistant Examiner*—D. Neal Muir

[57] ABSTRACT

A plastic clip is integrally formed to provide a flexible finger portion intermediate two relatively rigid finger portions. It is configured to be assembled within a hand-simulating portion of a doll appendage, with the flexible finger of the clip disposed within a thumb-like component of the hand, and it has elements which permit it to be sewn in place. The resiliency of the flexible finger portion will permit the thumb to flex when an object is inserted between it and the component that simulates the remaining fingers of the doll's hand, and to return to its normal position so as to grip the object therebetween.

11 Claims, 5 Drawing Figures

DOLL WITH GRIPPING HAND CONSTRUCTION AND CLIP THEREFOR

BACKGROUND OF THE INVENTION

In order to enhance the appeal of dolls and toy figures, they are often made to perform life-like functions, such as by providing simulated hands that are capable of gripping objects. Prior art forms of doll hands that are able to open and close are exemplified by the constructions shown shown in the following United States Patents:

Guadagna U.S. Pat. No. 2,733,545 discloses a structure to produce gripping between the thumb and the fingers of a doll's hand, which are spring loaded and can be bent through a range of configurations.

Ketcham U.S. Pat. No. 2.,884,739 shows a doll structure in which the plastic material from which the hand is made is relied upon to provide a gripping effect.

Schwartz U.S. Pat. No. 3,071,893 discloses a doll's hand which utilizes a spring clip made from metal to produce a gripping action between the thumb and index finger.

A gripping hand for dolls, which is made of a flexible plastic material having specified characteristics, is taught in Pugh U.S. Pat. No. 3,955,312.

Other forms of hands for dolls, which are capable of deformation and/or movement for gripping action, are disclosed in Lacmann U.S. Pat. No. 113,532, Alderson U.S. Pat. No. 440,986, Lyons U.S. Pat. No. 620,598, Goodsill U.S. Pat. No. 2,059,338, Lewis et al U.S. Pat. No. 3,693,288, Lewis et al U.S. Pat. No. 3,696,553 and Kuhn et al U.S. Pat. No. 4,186,517.

Despite the prior art activity evidenced by the foregoing, a need remains for simple, inexpensive and yet effective means by which a gripping action can be imparted to a hand-simulating appendage of a doll.

Accordingly, it is an object of the present invention to provide a novel appendage assembly for a doll, which is highly effective in its ability to grip an object, and which is nevertheless relatively simple and inexpensive to produce.

It is also an object of the invention to provide a novel clip member for use in such an assembly, which is adapted for facile and secure incorporation into the hand-similating portion of a doll appendage, which is of relatively simple, one-piece construction, and which is highly effective and durable.

SUMMARY OF THE INVENTION

It has now been found that certain of the foregoing and related objects of the invention are attained by the provision of a one-piece clip-like member integrally formed from a synthetic resinous material, which material is relatively rigid in relatively thick sections and resiliently deflectable in relatively thin sections. The member is comprised of a base portion having means for attachment to the structure of a doll appendage, a relatively rigid first finger portion, and a resiliently deflectable second finger portion, the finger portions having elements that extend generally parallel to one another so as to cooperatively define an outwardly opening slot therebetween. The member also includes a third, relatively rigid finger portion, which is spaced from the first finger portion and is disposed to contact the second finger portion at a point at which the latter is displaced from its normal position, to thereby prevent its movement therebeyond.

In preferred embodiments, the first and third finger portions of the clip member will be connected to the base portion, and the second finger portion will be connected to the first portion by an arcuate element. Advantageously, the first and second finger portions will have curved surfaces thereon to facilitate insertion of an object between them, and the facing surfaces of the parallel elements of which they are comprised will be indented to cooperatively define a recess within which the object can be seated.

In especially desirable embodiments, the first finger portion of the clip member will have an elongated outer element which extends away from the second finger portion and generally perpendicularly to the parallel elements, and which has means adjacent its free end for securing the member. It will advantageously have a necked-in section with an adjacent bulbous tip, to provide such securing means, and the means by which the base portion is attached to the material of the appendage may comprise loop elements which project laterally from each side of the base portion.

Other objects of the invention are attained by the provision of a gripping appendage assembly comprising a doll appendage fabricated from a pliant material, in combination with a one-piece clip member having the features hereinabove described. The appendage has a notched outer portion which defines relatively movable, directly adjacent components; the clip member is secured therewithin with its first finger portion disposed within one of the components, with its second and third finger portions disposed within the other component, and with its slot in general registration with the notch of the appendage. As a result, the resilient deflectablility of the second finger portion of the clip member will be imparted to the "other" component of the appendage, to thereby enable gripping of an object inserted between the two components.

Generally, the appendage will simulate a hand, the thumb being provided by the "other" component of its outer portion and the other fingers being provided, as a group, by the "one" component thereof. The assembly will beneficially include thread-like elements which are sewn through the pliant material, one such element lying generally within the necked-in section of the outer element of the clip, and another being engaged within one of the loop elements in its base portion, to secure the clip in assembly with the appendage.

DETAILED DESCRIPTION OF THE ILLUSTRATED EMBODIMENT

Figure 1:
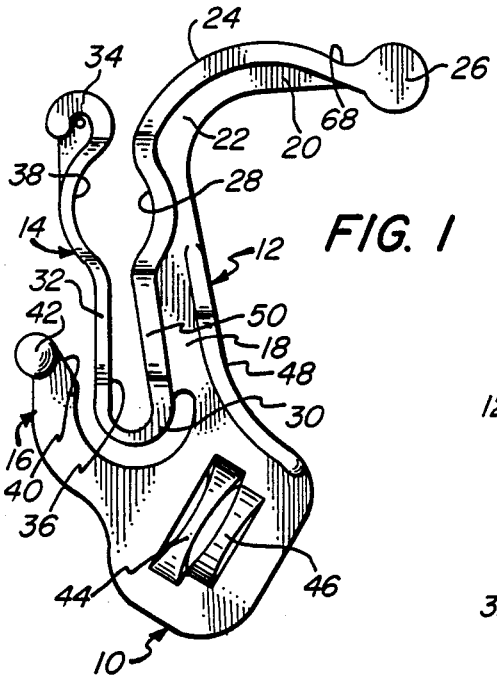
FIG. 1 is a side elevational view of a clip-like member embodying the present invention.
Figure 2:
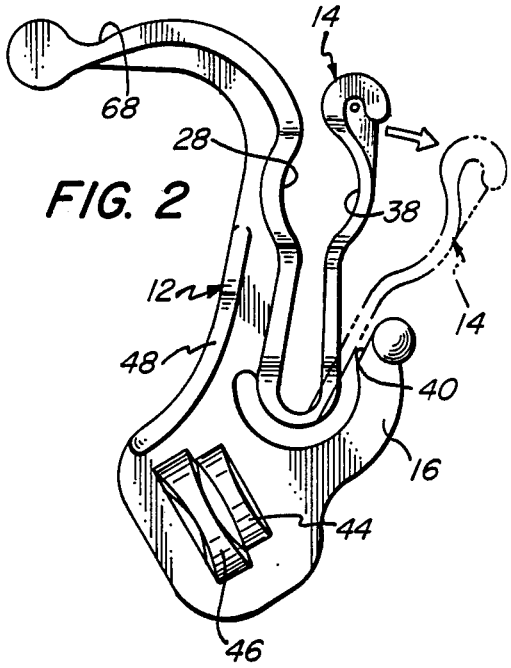
FIG. 2 is an opposite side elevational view of the clip member showing, in full and phantom line, respectively, the normal and deflected positions of the flexible finger portion.
Figure 3:
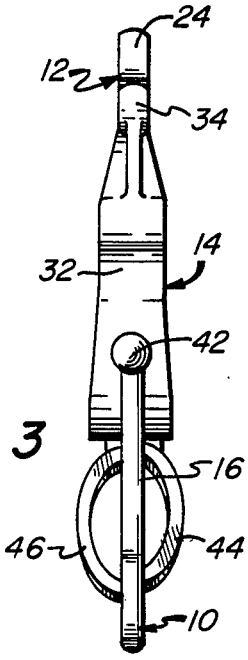
FIG. 3 is an edge view of the clip.

Turning initially to FIGS. 1–3 of the appended drawing, therein illustrated is a clip member embodying the present invention, which is of one-piece plastic construction. It consists of a base portion, a relatively rigid curved finger portion, a flexible finger portion, and a relatively short finger portion, generally designated respectively by the numerals 10, 12, 14 and 16. The curved finger portion 12 has a generally rectilinear element 18 which is attached to the base portion 10, and it has an outer element 20 which extends generally perpendicularly to the element 18 and is joined thereto through a knuckle element 22, which provides curved surface 24. An indentation 28 is formed along the rectilinear element 18, adjacent the surface 24, and the element 20 terminates in a flat bulbous tip 26.

The flexible finger portion or prong 14 is attached to the curved finger portion 12 through an arcuate transition element 30, the cross sectional dimensions of which, and of the rectilinear element 32 of the finger portion 14, are sufficiently small to afford the desired resilient deflectability. The finger portion 14 has a rounded tip element 34 at its outer end, which cooperates with the knuckle surface 24 of the curved finger portion 12 to provide a gradual lead-in passage to the slot 36 therebetween, and the flexible finger portion 14 has an indentation 38 facing the indentation 28, which cooperates therewith to provide an enlarged recess section of the slot 36.

The third finger 16 is relatively short and stout, and is disposed outwardly from the finger portion 12 beyond the finger portion 14; it is sufficiently strong and rigid to function as a physical stop, to arrest movement of the flexible finger. For that purpose, it is provided with a flattened inside abutment surface 40, which is disposed to contact the outer surface of the rectilinear element 32 when the finger portion 14 is flexed outwardly thereagainst. As will be readily appreciated, the function of the finger portion 16 is to prevent overstressing of the flexible finger portion 14, and loss of resiliency and possible breakage as a result. A knob-like tip 42 is formed at the outer end of the finger portion 16 to guard against damage to the covering material; the bulbous tip 26 and the rounded element 34 on the fingers portions 12 and 14, respectively, serve the same purpose as well as other functions herein described.

The base portion 10 of the clip member is formed to provide a pair of bowed elements or loops 44, 46, which protrude laterally from its opposite sides. Finally, and as will be noted, rib elements 48, 50 project laterally from the web area of the finger portion 12; they add strength and rigidity thereto and, in the case of the elements 50, extend as a continuation of the finger portion 14 and arcuate element 30.

Figure 4:
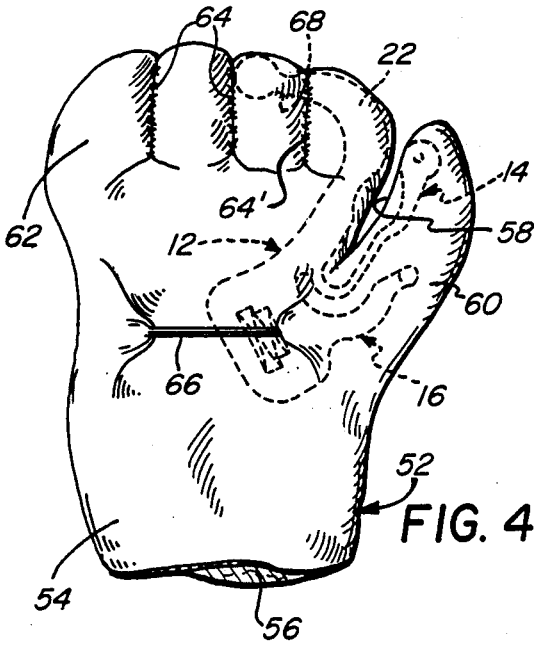
FIG. 4 is a fragmentary plan view of a hand-simulating doll appendage assembly embodying the invention, showing in dotted line the clip member assembled therewithin.
Figure 5:
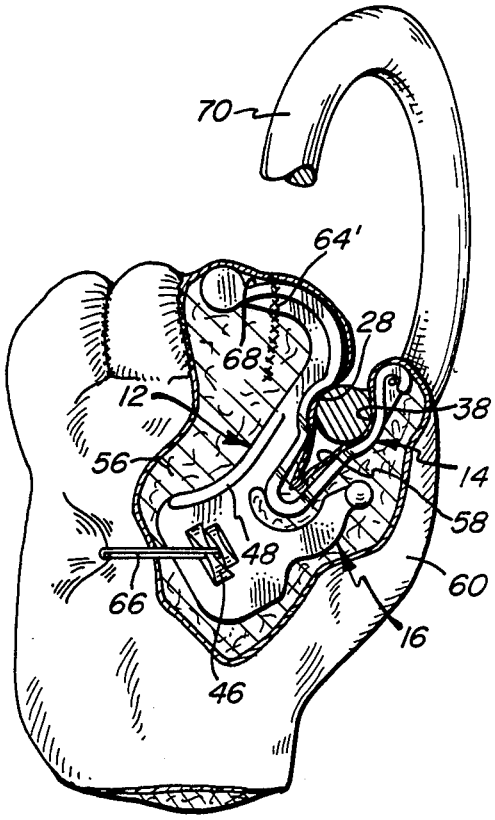
FIG. 5 is a view similar to that of FIG. 4, with a portion of the outer pliant material and some of the fibrous filler of the appendage removed to expose the clip member, and showing a ring-like object gripped between the thumb and other fingers of the simulated hand.

Turning now in detail to FIGS. 4 and 5, the clip member is shown assembled with hand-simulating doll appendage structure, generally designated by the numeral 52, which is formed of a pliant fabric 54 and is filled with a fibrous batting or stuffing material 56. The appendage is notched at 58 to provide a thumb component 60 and a component 62 adjacent thereto, individual finger elements being defined in component 62 by rows of stitching at 64, 64'.

As can best be seen in FIG. 5, the clip member is embedded within the stuffing material 56, and is positioned with the curved finger portion 12 disposed within the component 62; the flexible and stop finger portions 14, 16 are disposed within the thumb-simulating component 60, and the notch 58 is in registry with the slot 36 formed between the finger portions 12 and 14. The clip member is secured in place by a thread-like element 66, which is sewn through the material 54 in the wrist area of the appendage and passes about the protruding loop element 46. A second point of securement is provided by the line of stitching 64', which passes across the outer element 20 of the curved finger 12, generally within the necked-in section 68 thereof, in which position the likelihood of disassembly will be minimized.

The gripping action of the assembly is best illustrated in FIG. 5, wherein a ring-like object 70 has been inserted into the notch 58 between the components 60, 62 of the appendage structure 52. This has caused deflection of the flexible finger portion 14 of the clip member (as indicated in FIG. 2), permitting the object 70 to seat within the enlarged recess section defined by the confronting indentations 28, 38; the inherent resiliency of the finger portion 14 has of course caused it to close upon the object to hold it securely in place.

Although the use of an acetal resin (such as is commercially available from the duPont Company under the trade designation CELCON) has been found to be particularly advantageous for molding of the clip member, other synthetic resinous materials may of course be substituted. As will be evident to those skilled in the art, the important criteria for the plastic employed are toughness and durability, coupled with the ability to maintain inherent resiliency during an extended lifetime and through many flexural cycles. The particular configuration for the several elements of the clip may vary considerably from that illustrated and described, albeit that the form shown has been found to be particularly advantageous.

It will also be appreciated that the form of the appendage with which the clip is employed may vary widely as well, and need not be a hand-simulating part. For example, it may be desirable to impart grasping capability to a foot or a tail portion of a doll or like figure, and the clip member of the invention is readily adapted for use in such instances.

Thus, it can be seen that the present invention provides a novel appendage assembly for a doll, and a novel clip member employed therein, which are highly effective in their ability to grip an object, and which are nevertheless relatively simple and inexpensive to produce. The clip member is specifically constructed for facile and secure incorporation into the hand-similating portion of a doll appendage, and it is readily formed, as a single piece, from a synthetic resinous material.

Having thus described the invention, what is claimed is:

1. A doll having a gripping appendage, formed with a pair or relatively movable, opposed portions at the end thereof; and a one-piece clip member integrally formed from a synthetic resinous material which is relatively more rigid in relatively thicker sections of said clip member and resiliently more deflectable in relatively thinner sections of said clip member, said member being comprised of a base portion, a relatively more rigid first finger portion, and a resiliently more deflectable second finger portion connected to said first finger portion by a flexible arcuate section to provide resilient flexure of said second finger portion with respect to said first finger portion, said two finger portions having elements which extend generally parallel to one another and cooperatively define an outwardly opening slot therebetween, said member also having a stop portion which is relatively more rigid and is spaced from said first finger portion with said second finger portion disposed therebetween, said stop portion being positioned to contact said second finger portion at a point at which said second finger portion at a point at which said second finger portion is displaced from its normal position to prevent further movement thereof therebeyond, said clip member being disposed within said appendage with said finger portions of said member extending within said movable opposed portions thereof, said base portion having means thereon attaching said clip member to the structure of said doll appendage.

2. The doll of claim 1 wherein said stop portion is in the form of a third finger portion, wherein said first and third finger portions are connected to said base portion.

3. The doll of claim 2 wherein said first and second finger portions have curved surfaces thereon in general lateral alignment with one another at the entrance to said slot to facilitate insertion of an object between the opposed movable portions of said appendage, and wherein the facing surfaces of said parallel finger elements are indented to cooperatively define a recess within which the object can be engaged.

4. The doll of claim 1 wherein said first finger portion has a elongated outer element which extends away from said second finger portion and generally perpendicularly to said parallel elements thereof, said outer element having means adjacent the free end thereof securing said clip member to the material of said doll apendage.

5. The doll of claim 4 wherein said securing means comprises a necked-in said outer element, said element terminating in a bulbous tip.

6. The doll of claim 1 wherein said attaching means comprises a loop element projecting laterally from each side of said base portion.

7. A stuffed simulated figure doll having a gripping appendage fabricated from a pliant material and having a notched outer portion including a pair of relatively movable, directly adjacent opposed components; and a one-piece clip member integrally formed from a synthetic resinous material which is relatively more rigid in relatively thicker sections of said clip member and resiliently more deflectable in relatively thinner sections of said clip member, said member being comprised of a base portion, a relatively rigid first finger portion, and a resiliently deflectable second finger portion connected to said first finger portion by a flexible arcuate section to provide resilient flexure of said second finger portion with respect to said first finger portion, said first and second finger portions having elements which extend generally parallel to one another and cooperatively define an outwardly opening slot therebetween, said member also having a stop portion which is relatively more rigid and is spaced from said first finger portion with said second finger portion disposed therebetween, said stop portion being positioned to contact said second finger portion at a point at which said second finger portion is displaced from its normal position to prevent further movement thereof therebeyond, said base portion having means thereon attaching said clip member to the structure of the doll appendage, said clip member being secured within said outer portion of said appendage with said first finger portion thereof disposed within one of said opposed components of said outer portion, with said second finger and stop portions disposed within the other of said opposed components, and with said notch of said outer portion registering generally with said slot of said clip member, whereby the resilient deflectability of said second finger portion is imparted to said other of said opposed components of said appendage to enable gripping of an object thereby.

8. The doll of claim 7 wherein said appendage simulates a hand, the thumb of which is provided by said other component of said outer portion and the other fingers of which are provided as a group by said one component thereof, said first finger portion of said clip member having an outer element which extends away from said second finger portion and generally perpendicularly to said parallel elements thereof, said outer element having means adjacent the free end thereof for securing said clip member within said one component of said appendage.

9. The doll of claim 8 wherein said securing means of said clip member comprises a necked-in section of said outer element disposed adjacent a bulbous tip in which said element terminates, and wherein said assembly additionally includes a thread-like element sewn through said pliant material and lying generally within said necked-in section of said outer element.

10. The doll of claim 9 wherein said attachment means of said clip member comprises a loop element projecting laterally from each side of said base portion, and wherein said assembly additionally includes a thread-like element sewn through said pliant material and engaged through one of said loop elements.

11. The doll of claim 7 wherein said stop portion comprises a third finger portion which projects from said base portion, said third finger portion having a flattened surface adjacent its outer end and generally facing said second finger portion to contact, and to thereby arrest movement of, said second finger portion when flexed toward said third finger portion from a normal position thereof.

* * * * *

UNITED STATES PATENT AND TRADEMARK OFFICE

CERTIFICATE OF CORRECTION

PATENT NO. : 4,725,257

DATED : February 16, 1988

INVENTOR(S) : Michael S. Barishman and Lester H. Olinsky

It is certified that error appears in the above-identified patent and that said Letters Patent is hereby corrected as shown below:

Column 5, line 35, after "necked-in", insert -- section of --.

Signed and Sealed this

First Day of November, 1988

*Attest:*

*Attesting Officer*

DONALD J. QUIGG

*Commissioner of Patents and Trademarks*